United States Patent [19]

Karklys

[11] Patent Number: 4,564,733

[45] Date of Patent: Jan. 14, 1986

[54] CURRENT LIMITING CONTROL CIRCUIT FOR INDUCTION RANGE

[75] Inventor: Joseph Karklys, St. Joseph, Mich.

[73] Assignee: Whirlpool Corporation, Benton Harbor, Mich.

[21] Appl. No.: 522,806

[22] Filed: Aug. 11, 1983

[51] Int. Cl.[4] ..... H05B 6/06

[52] U.S. Cl. ..... 219/10.77; 219/10.49 R; 219/486; 307/41; 307/141; 307/141.8; 361/89; 361/94

[58] Field of Search ..... 219/10.77, 10.75, 10.49 R, 219/486, 485; 307/38, 39, 40, 41, 141, 141.4, 141.8, 30, 32, 35; 361/94, 89, 98, 111

[56] References Cited

U.S. PATENT DOCUMENTS

| | | | |
|---|---|---|---|
| 3,457,430 | 7/1969 | Samuelson | 307/41 |
| 3,506,907 | 4/1970 | Porterfield et al. | 219/10.77 X |
| 3,770,977 | 11/1983 | McIntosh | 219/486 X |
| 3,925,633 | 12/1975 | Partridge | 219/10.49 R |
| 4,112,287 | 9/1978 | Oates et al. | 219/10.49 R |
| 4,115,677 | 9/1978 | Yamamura et al. | 219/10.49 R |
| 4,138,607 | 2/1979 | Engelmann | 307/41 X |
| 4,227,062 | 10/1980 | Payne et al. | 307/41 X |
| 4,242,554 | 12/1980 | Hurko et al. | 219/10.55 B |
| 4,313,061 | 1/1982 | Thomas | 307/32 |

*Primary Examiner*—Philip H. Leung

*Attorney, Agent, or Firm*—Wood, Dalton, Phillips, Mason & Rowe

[57] ABSTRACT

The provision in a range having an electrically energizable heating unit and a control for selectively causing energization of the heating unit from a power supply of an improved circuit for causing time-delayed initiation of energization of the heating unit for a period of time which is a function of the period of inrush current which occurs when the heating unit is energized. The circuit causes such a delay in the event the circuit senses a preselected power delivery from the power supply at the time of attempted initiation of energization of the heating unit. The novel circuit is advantageously utilized in a range having a plurality of electrically energizable heating units and assures that the heating units will be sequentially energized with a time delay between initiation of energization of each so that the total inrush current is substantially less than the sum of all of the inrush currents of the heating units concurrently attempted to be energized.

18 Claims, 18 Drawing Figures

FIG. 3
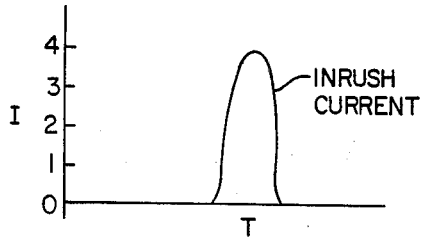
FIG. 4
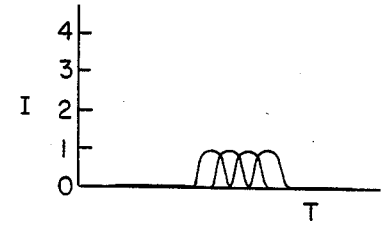
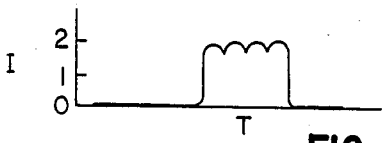
FIG. 5
FIG. 6
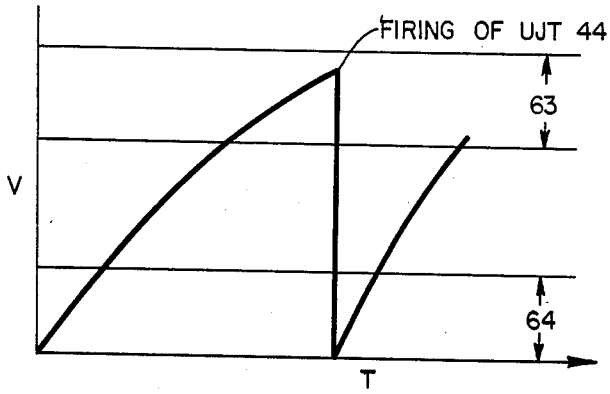
FIG. 7
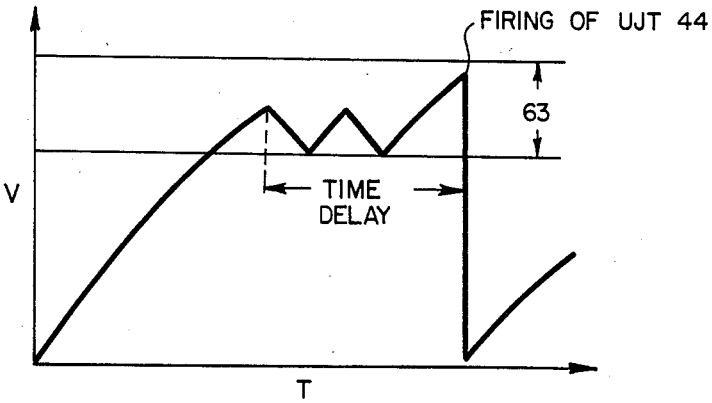

CURRENT LIMITING CONTROL CIRCUIT FOR INDUCTION RANGE

BACKGROUND OF THE INVENTION

1. Field of the Invention

This invention relates to electric ranges and in particular to controls for use with induction heating units for use therein.

2. Description of the Background Art

In one form of electric range, an induction cooking coil is provided in the range top. A high frequency oscillator provides an alternating excitation current at about 25 KHz for a 1300-watt input.

In one background range unit of this type illustrated in U.S. Pat. No. 4,112,287 of Robert M. Oates et al., power to four induction heating coils is controlled by four triacs connected respectively between the power oscillator and the induction coils. The patentees teach that where a plurality of induction cooking coils are excited, the effective load switching frequency, as seen by the line, can be further increased by phase-delaying the triac switching signals of each work coil relative to each other so that the triacs switch sequentially. The triacs are independently switched to provide duty cycles providing desired average cooking power for each cooking coil.

Hideo Yamamura et al., in U.S. Pat. No. 4,115,677, disclose an induction heating apparatus wherein the heating coils are connected to the output terminal of an inverter circuit so as to be cyclically supplied for a predetermined time of a predetermined cycle. The control includes a plurality of output adjusting means for setting the output period of the respective coils.

In U.S. Pat. No. 4,242,554, Bohdan Hurko et al., disclose a time ratio control system for a microwave oven. The method of operation comprises alternately energizing each of the electrical resistance food browning system and the microwave energy generating system for different intervals during the cooking operation. Each energization interval is approximately 30 seconds.

Donald G. Thomas discloses, in U.S. Pat. No. 4,313,061, a method and apparatus for supplying electrical current to a number of loads by means of heat-controlled switches, such as SCR's. The technique involves generating a load sequence waveform and during each period of the waveform, generating a load firing pattern for initiating the flow of a current in each load. The currents in each of the loads are initiated at instants which are a number of full cycles of the AC source apart. The current is maintained in each load for another number of full cycles.

In U.S. Pat. No. 3,457,430, Robert W. Samuelson discloses a control circuit for preventing energization of first and second loads by a common voltage source upon concurrent actuation of switching means associated therewith. The switching means comprises triacs. A pair of static element load control circuits is provided, each having a normal first condition and a second condition in response to whether an actuation of an associated actuatable switching means has occurred. The control controls energization of the load switching means in such a manner that neither of the loads is energized when both of the actuatable switching means are concurrently actuated.

SUMMARY OF THE INVENTION

The present invention comprehends an improved range structure having an electrically energizable induction heating unit and control means selectively operable to cause energization of the heating unit from a power supply. The invention comprehends the provision of circuit means for causing a time-delayed initiation of energization of the heating unit for a period of time which is a function of the period of inrush current which occurs when the heating unit is energized.

In the illustrated embodiment, the control circuit causes the energization of the heating unit to be so delayed in the event the circuit means senses a preselected power delivery from the power supply at the time of attempted initiation of energization of the heating unit.

More specifically, the invention comprehends the provision of circuit means for delaying initiation of energization of a second of such heating units until the inrush current of a first heating unit reaches its peak following initiation of energization of said first heating unit in the event the control means is operated to attempt to initiate energization of both heating units simultaneously.

In the illustrated embodiment, the control means includes gate-controlled switching means associated one each with the respective heating units, and the circuit means includes a counter, a plurality of oscillators associated one each with the respective heating units, a plurality of NAND gates connected one each to the respective oscillators, means for connecting the counter to one input of each of the respective NAND gates, each said NAND gate disabling its associated oscillator in the event the NAND gate is true.

In the illustrated embodiment, the circuit means comprises means for delaying triggering of further gate-controlled switching means subsequent to triggering of a preceding gate-controlled switching means.

The circuit means, in the illustrated embodiment, comprises means for limiting the maximum inrush current to the group of heating units to substantially less than one-half the sum of the inrush currents to each heating unit as an incident of the sequential energization thereof.

In the illustrated embodiment, means are provided for adjusting the repetition frequency of the gate-controlled switching means.

In the illustrated embodiment, means are provided for adjusting the electrical power delivered from the control means to the respective heating units.

The range control structure of the present invention is extremely simple and economical, while yet providing highly improved control of the energization of induction range heating units.

BRIEF DESCRIPTION OF THE DRAWING

Other features and advantages of the invention will be apparent from the following description taken in connection with the accompanying drawing wherein:

FIG. 3 is a graph showing the relatively high total inrush current of the four heating coils of FIG. 1 without the use of the present invention;

FIG. 4 is a graph showing the relatively low inrush current of the four heating coils operating together using the present invention;

FIG. 5 is a graph illustrating the relatively low sum of the inrush currents of FIG. 4 using the present invention;

FIG. 6 is a graph illustrating different voltage conditions with respect to time at point B of the control circuit of FIG. 2;

FIG. 7 is a graph illustrating the voltage at point B where the NAND gate of the circuit is true;

DESCRIPTION OF THE PREFERRED EMBODIMENT

Figure 1:
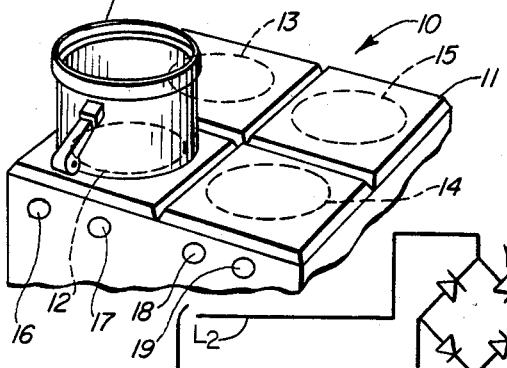
FIG. 1 is a fragmentary perspective view of an induction heating range.

In the illustrative embodiment of the invention as disclosed in the drawing, an induction heating range generally designated 10 is shown to comprise a cooktop 11 having a plurality of induction heating work coils 12, 13, 14 and 15. The range further includes suitable manual controls 16, 17, 18 and 19 for selectively turning the induction heating work coils on and off.

Figure 2:
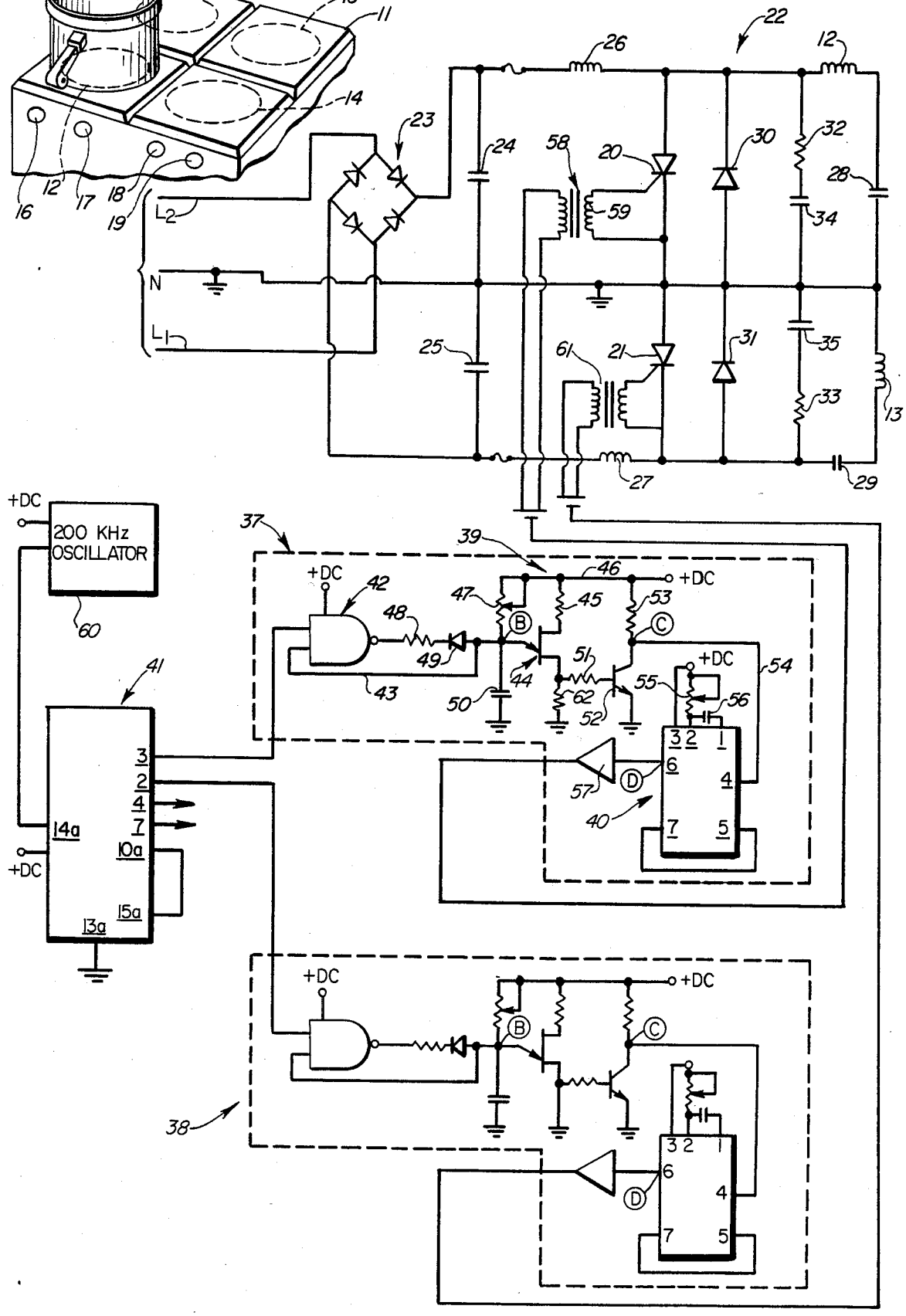
FIG. 2 is a schematic wiring diagram illustrating the control circuitry of the invention.

Referring to FIG. 2, the control circuit for two of the induction heating work coils, such as work coils 12 and 13, is illustrated, it being understood that the circuitry may include any desired plurality of induction heating coils, with the additional heating coils being connected similarly as coil 13.

The heating coils may comprise conventional induction heating work coils having an approximately 30 $\mu$H inductance. The coils are selectively energized by means of gate-controlled switching elements, such as silicon controlled rectifiers 20 and 21, respectively. In the illustrated embodiment, the gate-controlled switches comprise asymmetrical silicon controlled rectifiers (ASCR's), forming a portion of a resonant circuit 22 facilitating automatic turn-off of the rectifier by providing reverse current flow through the circuit.

As shown in FIG. 2, power supply leads $L_1$ and $L_2$ may comprise conventional 110-volt alternating current power supply leads. The alternating current voltage is rectified by a full wave bridge rectifier 23 and filtered by 5.6 $\mu f$ capacitors 24 and 25.

The rectified direct current is fed through a charging choke 26 and 27 to the resonant circuit. The choke isolates the resonant circuit from the DC power supply during the resonant cycle, and, in the illustrated embodiment, has an inductance of approximately 1 mH.

The resonant cycle is initiated by gating the switch 20,21 on, causing power current to flow through the switch, the work coils, 12,13, and a resonant capacitor 28,29, which, in the illustrated embodiment, comprise a 0.68 $\mu f$ 800-volt DC capacitor. A fast recovery diode 30,31 and an RC snubbing network, including a resistor 32,33, and a capacitor 34,35, are connected antiparallel to the gated switch. As soon as current reverses in the resonant circuit, it will flow through the diode 30,31 to quickly turn off the gated switch.

Where there is no load, such as when the pot 36 is not on the cooktop over the work coil 12, the magnitude of the gated switch and diode currents will be equal. When the pot is placed over the work coil 12, the current through the gated switch will be several times higher than that through the diode and current will be induced in the skin of the pot 36. Thus, in use, the diode current is substantially less than the current of the work coil, and the current rating of the diode may be substantially lower than that required for the ASCR.

In normal operation, the resonant frequency of the circuit is determined by the work coil inductance and the resonant circuit capacitor. In the illustrated embodiment, under no-load conditions, the ASCR conduction period is approximately 3.14 times the square root of LC.

The gate pulse frequency, or repetition frequency, of the circuit is adjustable and is proportional to the power input to the work coil. Illustratively, in a control circuit built as discussed above, the resonant frequency was approximately 50 KHz, and the repetition frequency was approximately 25 KHz for about a 1300-watt input to the circuit of each work coil. The voltage across the ASCR during the non-conducting period was approximately 560 volts and peak current through the ASCR was 95 amperes.

As indicated briefly above, the invention comprehends the provision of additional circuitry, such as circuits generally designated 37 and 38, preventing the simultaneous firing of two or more work coils. Thus, in illustrating the invention in FIG. 2, two control circuits 37 and 38 are shown for controlling delivery of power to the coils 12 and 13, respectively.

In broad aspect, the control constitutes a multiple coil induction range control circuit limiting the system currents while allowing individual power level control for each coil. Each of circuits 37 and 38 is identical and, thus, the following description will be directed to circuit 37, it being understood that the description applies equally to circuit 38 and any additional circuits provided in connection with additional work or heating coils, such as coils 14 and 15 identified in FIG. 1.

As shown in FIG. 2, the control circuit 37 includes a variable frequency oscillator 39 and a monostable multivibrator 40 (single shot RCA 4098). One port of a ring counter 41 is connected to one input of a NAND gate 42. A feedback connection 43 is provided from the oscillator 39 to the other input of the NAND gate.

In the illustrated embodiment, oscillator 39 includes a unijunction transistor generally designated 44 connected through a resistor 45 to positive DC power supply lead 46. The input to the transistor 44 is connected through a potentiometer 47 to lead 46. The output of NAND gate 42 is connected through a resistor 48 and diode 49 to the input of unijunction transistor 44. As further shown in FIG. 2, the input of unijunction transistor 44 is connected through a capacitor 50 to ground.

The other output terminal of transistor 44 is connected through a resistor 51 to a second transistor 52 having one output terminal connected through a resistor 53 to lead 46 and the other output terminal connected to ground. As further shown in FIG. 2, the first output terminal of transistor 52 is connected through a lead 54 to terminal 4 of the monostable multivibrator 40.

A potentiometer 55 is connected between the positive DC power supply and terminal 2 of the multivibrator. A capacitor 56 is connected between terminal 2 and terminal 1 thereof.

Terminal 6 of the multivibrator is connected through an amplifier 57 to the gate transformer 58, having its secondary 59 connected between the gate of the ASCR 20 and ground.

As further shown in FIG. 2, a conventional 200 KHz oscillator 60 is connected to terminal 14*a* of the ring counter 41.

As shown in FIG. 2, circuit portion 38 is identical to circuit portion 37 and is connected to the transformer 61 connected to the ASCR 21 to function therewith in an identical manner as circuit 37 with ASCR 20.

Briefly, the control circuit 37 functions so as to cause the voltage buildup on oscillator capacitor 50 to be limited when the NAND gate 42 is "true", i.e. the two inputs to the NAND gate are at logic 1. Under such conditions, the oscillator 39 is prevented from causing the monostable multivibrator 40 from delivering a gating pulse to the associated ASCR 20 as the NAND gate 42 causes the capacitor 50 to momentarily discharge, thus preventing the firing.

The functioning of the control circuit 37 in conjunction with control circuit 22 is best understood with reference to the graphs of FIGS. 3–18. As shown in FIG. 3, if the present invention were not employed a relatively high inrush current would result in the event that all four of the heating coils 12, 13, 14 and 15 would be turned on by firing of their associated ASCR's concurrently.

FIG. 4 illustrates the relatively low inrush current effect of the present invention in delaying the firing of the respective ASCR's and illustrates the respective inrush currents i.e. buildup of the four heating coils when the initiation of energization thereof is spaced apart timewise a period equal to the rise time of the respective inrush currents.

In FIG. 5, the total or integrated inrush currents when the present invention is used are shown to be less than one-half of the maximum inrush current illustrated in FIG. 3 which illustrates the relatively high inrush currents in the absence of the present invention.

Figure 8:
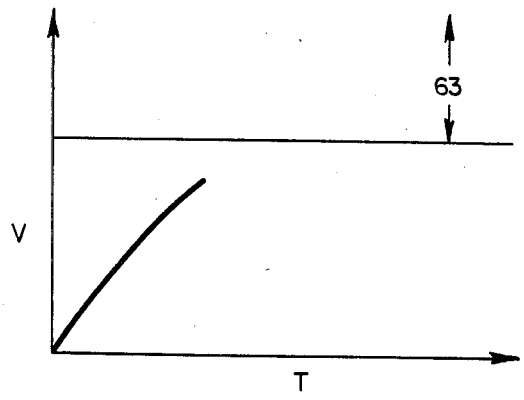
FIG. 8 is a graph illustrating the voltage at point B below logic 1.

Graphs in FIGS. 6–8 illustrate the voltage conditions with respect to time existing at point B of circuit portion 37 under different operating conditions. In FIG. 6, it is assumed that logic 0 is applied to the NAND gate 42 from the counter 41, thereby maintaining the output of the NAND gate high at logic 1. When the voltage at point B increases to the triggering voltage level of the unijunction transistor 44, the unijunction transistor fires and then discharges to a low voltage level as shown in FIG. 6. As shown in FIG. 2, one output terminal of the unijunction transistor is connected through resistor 45 to the positive DC voltage line 46, and the other output terminal is connected through a resistor 62 to ground. These resistors comprise biasing resistors relative to the unijunction transistor 44. As shown in FIG. 6, the firing point of unijunction transistor 44 is in a range of voltage 63 at point B indicating a logic 1 output of the NAND gate. The range 64 is the logic 0 voltage range for the NAND gate.

Referring now to the graph of FIG. 7, the voltage 63 at point B is indicated with a logic 1 input to the NAND gate from the counter 41 and a logic 1 input to the NAND gate from point B. As indicated the voltage at point B initially increases until it reaches the logic 1 range, at which time the voltage is discharged through the diode 49 and resistor 48 connected to the output of the NAND gate. This causes the voltage level at point B to decrease until it reaches the lower level of the logic 1 range, whereupon it increases again, with this cycle being repeated as illustrated by the sawtooth curve portion of FIG. 7. The sawtooth portion thusly represents a time delay in the firing of the unijunction transistor 44, as seen by comparison of the curves of FIGS. 6 and 7.

As shown, when the counter 41 output to the NAND gate goes to zero, the voltage level at B again increases until the unijunction transistor 44 again fires.

FIG. 8 illustrates the voltage condition at point B when the counter 41 provides a logic 1 input to the NAND gate at the time the voltage at point B is below the logic 1 range 63. As shown, nothing happens under these circumstances.

The output of transistor 52 at point C is connected by the lead 54 to the single shot multivibrator 40, as discussed above. The resistor 53 comprises a collector current limiting resistor. The output of transistor 52 goes to ground whenever the unijunction transistor 44 is fired.

Figure 9:
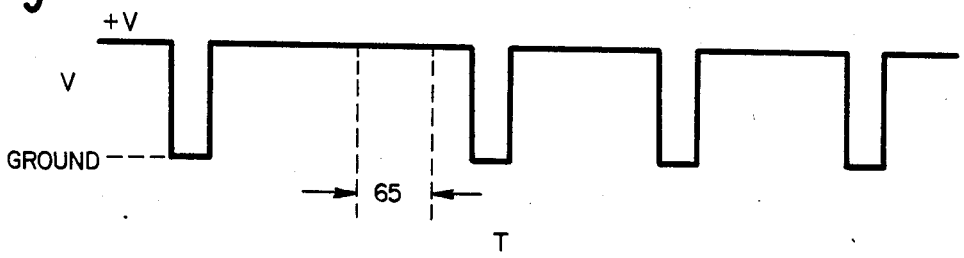
FIG. 9 is a graph illustrating the voltage at point C of FIG. 2 when the NAND gate is true.

NAND gate 42 generates a logic 0 output when it receives a logic 1 signal from counter 41 concurrently with a logic 1 signal fed back from point B, which occurs when the voltage at point B is in the logic 1 range 63. Under such conditions, capacitor 50 discharges at a fixed rate through the diode 49 and resistor 48 to ground through the NAND gate 42. The voltage waveform generated under these conditions at point C is illustrated in FIG. 9 to have a time delay occurring between two successive unijunction transistor 44 firings caused by the simultaneous application of two logic 1 signals to the NAND gate. The time delay is illustrated at 65 in FIG. 9.

Figure 10:
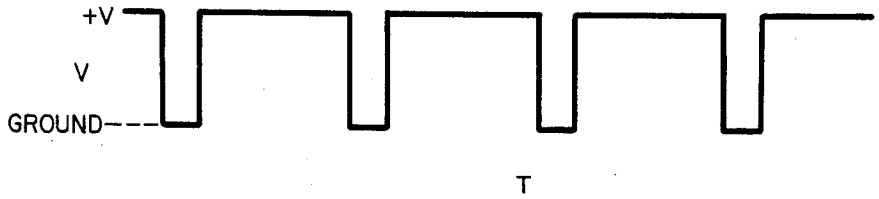
FIG. 10 is a graph illustrating the voltage waveform at point C when the NAND gate is not activated.

The voltage waveform at point C, when the NAND gate is not activated, is illustrated in FIG. 10. Such a condition occurs when only one or none of the NAND gate inputs is logic 1.

Figure 11:
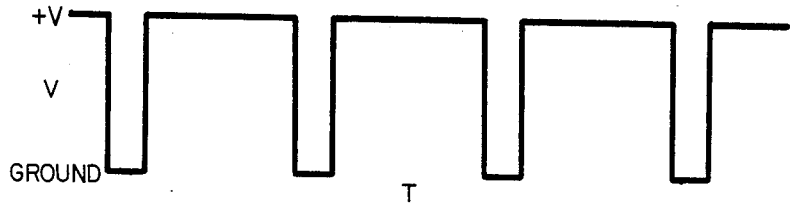
FIG. 11 is a graph illustrating the voltage at point C with a potentiometer associated therewith at a normal setting.
Figure 12:
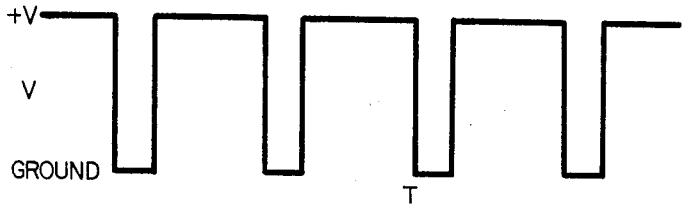
FIG. 12 is a graph illustrating the voltage at point C wherein the repetition frequency is increased by suitably changing the potentiometer.
Figure 13:
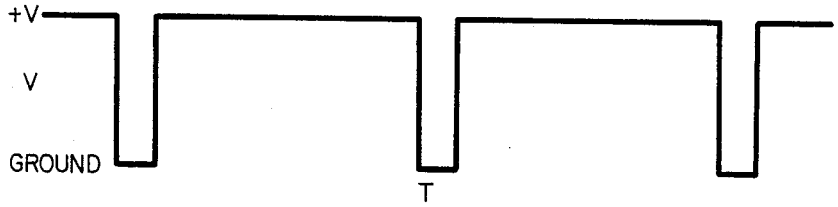
FIG. 13 is a graph illustrating the voltage at point C where the potentiometer is changed to decrease the repetition frequency.

As indicated above, the repetition frequency may be varied to correspondingly vary the power input level to the coils 12, 13, 14 and 15, by means of potentiometer 47. The potentiometer is normally adjusted at the factory to adjust the repetition frequency to a desired frequency. FIGS. 11, 12 and 13 illustrate changes in the repetition frequency effected by correspondingly greater adjustment of the setting of the potentiometer 47.

Figure 14:
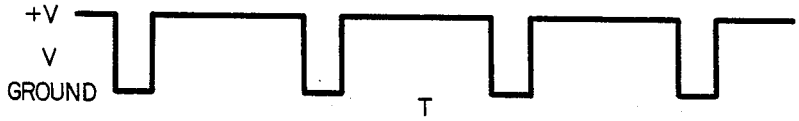
FIG. 14 illustrates the waveform of the voltage at point C under one operating condition of the control circuit.
Figure 15:
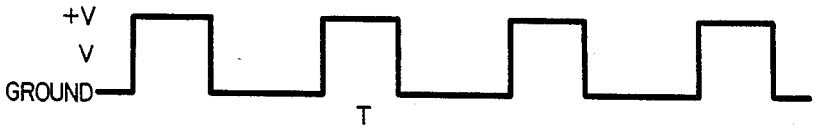
FIG. 15 is a graph showing the concurring waveform of the voltage output of the monostable multivibrator of the control circuit.
Figure 16:
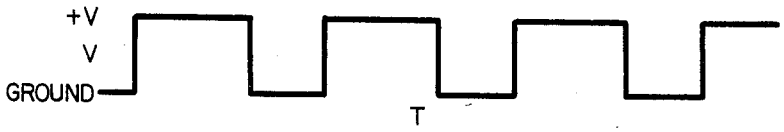
FIG. 16 is a graph illustrating the voltage at the output of the multivibrator as a result of adjusting a potentiometer associated therewith for a wider pulse.

As indicated above, a second potentiometer 55 is provided in circuit 37 for varying the width of the output pulse generated by the single shot multivibrator 40. The width of the output pulse from the multivibrator at point D is adjusted by adjustment of potentiometer 55. FIG. 14 illustrates the waveform of the output of transistor 52 at point C, and FIGS. 15 and 16 illustrate the concurring waveform of the output of the single shot multivibrator at point D. In FIG. 15, the output is shown with a normal adjustment setting for potentiometer 55, and in FIG. 16, the output is illustrated as resulting from an adjustment of potentiometer 55 to provide a substantially wider pulse.

Figure 17:
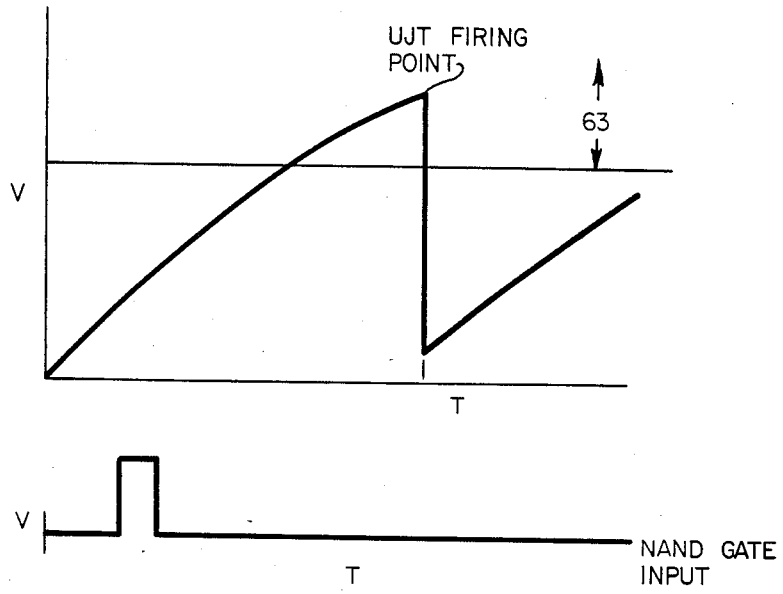
FIG. 17 is a graph illustrating the voltage at point B wherein the inputs to the NAND gate are logic 1 from the counter and logic 0 from point B.
Figure 18:
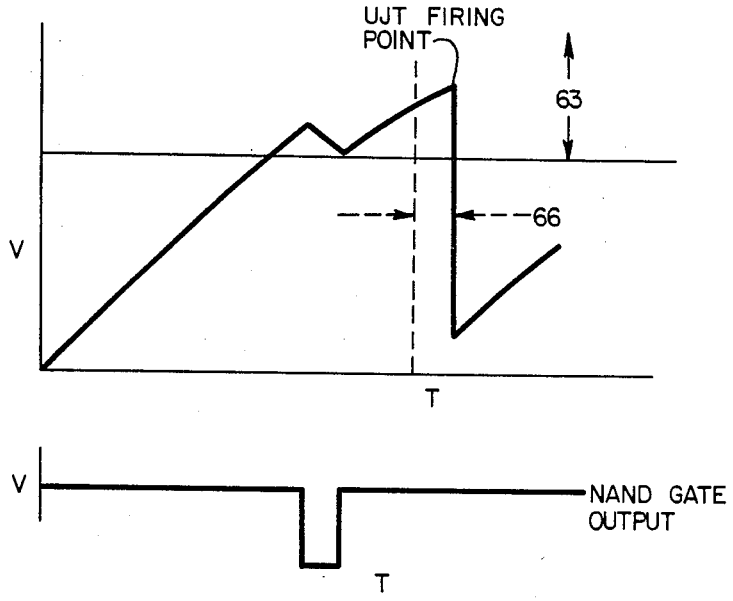
FIG. 18 is a graph of the voltage at point B wherein the NAND gate is true illustrating the provision of a time delay for the inrush current by delaying the time for firing of the unijunction transistor of the control circuit.

FIGS. 17 and 18 illustrate the voltage at point B, with the NAND gate input at logic 1 from the counter 41 and logic 0 from point B, so that under these conditions nothing happens (no time delay introduced) to prevent the unijunction transistor 44 from firing in its normal sequence.

However, when the NAND gate inputs are both logic 1 from the counter and feedback from point B, the resultant NAND gate output goes to logic 0 as illustrated in FIG. 18, and the voltage at point B is seen to decrease and then increase again until it finally reaches the unijunction transistor firing point, so that effectively the firing of the unijunction transistor is delayed by the time spacing of the firing point between that illustrated in FIG. 17 and that illustrated in FIG. 18. The delay 66 is illustrated in FIG. 18. Once the unijunction transistor fires, the multivibrator provides a full length gate pulse to the ASCR 20, insuring positive operation and turn-off of the ASCR.

Thus, the control circuit 37 assures that the individual heating coils will not be energized concurrently notwithstanding the manipulation of the controls 16, 17, 18 and 19 attempting to effect such concurrent initiation of operation. Resultingly, the total inrush current will be limited to that illustrated in FIG. 5 by automatically preventing simultaneous firing of two or more of the heating coils.

The unijunction oscillator 39 effectively determines the repetition frequency for each working coil, and may be adjusted as discussed above by the setting of potentiometer 47, as desired. The counter 41, in the illustrated embodiment, sequences about 5-μsecond time slots for each working coil. The NAND gate 42 is activated only when the unijunction voltage at point B is in the firing range for one of the gate inputs, and the 5-millisecond pulse is high for the preceding heating coil. This causes an automatic delay in the firing of the unijunction for 5 μseconds or less. In the illustrated embodiment, the inrush current for each heating coil reaches its peak sequentially 5 μseconds or more after the previous coil was activated. Once the unijunction oscillator is fired, the single shot multivibrator assures a full length gate pulse to the ASCR trough. The gate amplifier 57 assures positive operation and turn-off of the ASCR.

The foregoing disclosure of specific embodiments is illustrative of the broad inventive concepts comprehended by the invention.

I claim:

1. In a range having at least two electrically energizable heating units, and control means selectively operable to cause energization of said heating units with an electrical current having an initial inrush buildup, the improvement comprising circuit means for causing initiation of energization of a second of said heating units substantially at the time the inrush current of a first heating unit reaches its peak following initiation of energization of said first heating unit in the event said control means is operated to attempt to initiate energization of both heating units simultaneously.

2. The range structure of claim 1 wherein said control means comprises gate-controlled switching means associated one each with the respective heating units, and said circuit means comprises means for delaying triggering of further gate-controlled switching means subsequent to triggering of a preceding gate-controlled switching means.

3. The range structure of claim 1 wherein said circuit means comprises means for limiting the maximum inrush current to the group of heating units to less than one-half of the sum of the inrush currents to each heating unit as an incident of the sequential energization thereof.

4. The range structure of claim 1 wherein said circuit means includes an oscillator and a NAND gate connected to the oscillator for disabling the oscillator in the event the NAND gate is true.

5. The range structure of claim 1 wherein said circuit means includes a counter, a plurality of oscillators associated one each with the respective heating units, a plurality of NAND gates connected one each to the respective oscillators, and means for connecting the counter to one input of each of the respective NAND gates, each said NAND gate disabling its associated oscillator in the event the NAND gate is true.

6. The range structure of claim 1 wherein said circuit means includes a counter, a plurality of oscillators associated one each with the respective heating units, a plurality of NAND gates connected one each to the respective oscillators, means for providing a feedback connection from each oscillator to the other input of its associated NAND gate, and means for connecting the counter to one input of each of the respective NAND gates, each said NAND gate disabling its associated oscillator in the event the NAND gate is true.

7. The range structure of claim 1 wherein said circuit means includes a ring counter, a plurality of oscillators associated one each with the respective heating units, a plurality of NAND gates connected one each to the respective oscillators, means for providing a feedback connection from each oscillator to the other input of its associated NAND gate, and means for connecting the ring counter to one input of each of the respective NAND gates, each said NAND gate disabling its associated oscillator in the event the NAND gate is true.

8. The range structure of claim 1 wherein said circuit means includes an oscillator including a capacitor, and a NAND gate connected to the oscillator capacitor for limiting the voltage buildup thereon and thereby disabling the oscillator in the event the NAND gate is true.

9. The range structure of claim 1 wherein means are provided for adjusting the electrical power delivered from said control means to the respective heating units.

10. The range structure of claim 1 wherein said control means comprises gate-controlled switching means associated one each with the respective heating units, and said circuit means comprises means for delaying triggering of further gate-controlled switching means subsequent to triggering of a preceding gate-controlled switching means, and further including means for adjusting the repetition frequency of the gate-controlled switching means for correspondingly varying the electrical power provided to the associated heating unit.

11. The range structure of claim 1 wherein said control means comprises gate-controlled switching means associated one each with the respective heating units, and said circuit means comprises means for delaying triggering of further gate-controlled switching means subsequent to triggering of a preceding gate-controlled switching means, and including adjustable means for providing an adjustable width trigger pulse to the gate-controlled switching means.

12. In a range having at least two electrically energizable induction heating units, and control means including gate-controlled switching means associated one each with the respective heating units and selectively operable to cause energization of said heating units with an electrical current having an initial inrush buildup, the improvement comprising circuit means for causing a time-delayed initiation of energization of a second of said heating units substantially at the time the inrush current of a first heating unit reaches its peak following initiation of energization of the first heating unit in the event said control means is operated to attempt to initiate energization of both heating units simultaneously, said circuit means including a counter, a plurality of oscillators associated one each with the respective heating units, a plurality of NAND gates connected one each to the respective oscillators, and means for connecting the counter to one input of each of the respective NAND gates, each such NAND gate disabling its associated oscillator in the event the NAND gate is true.

13. The range structure of claim 12 wherein said counter comprises a ring counter.

14. The range structure of claim 12 further including means for providing a feedback connection from each oscillator to the other input of its associated NAND gate.

15. The range structure of claim 12 wherein said circuit means includes a monostable multivibrator for providing drive pulses to said gate-controlled switching means.

16. The range structure of claim 12 wherein said circuit means includes a monostable multivibrator for providing drive pulses to said gate-controlled switching means and adjustable means for providing an adjustable full width trigger pulse to the gate-controlled switching means.

17. The range structure of claim 12 wherein said circuit means includes a monostable multivibrator for providing drive pulses to said gate-controlled switching means, a unijunction transistor, and adjustable means for controlling the firing of the unijunction transistor for adjusting the repetition frequency of the multivibrator.

18. In a range having a first electrically energizable heating unit and a second electrically energizable unit, and control means selectively operable to cause energization of said heating unit from a power supply with an electrical current having an initial inrush buildup, the improvement comprising circuit means for causing a time-delayed initiation of energization of said second unit for a period of time which is preselected as a function of the period of inrush current of the first unit which occurs when said heating unit is energized in the event said circuit means senses said current buildup at the time of attempted initiation of energization of said second unit.

* * * * *